US011454444B1

(12) United States Patent
Bloemendaal

(10) Patent No.: US 11,454,444 B1
(45) Date of Patent: Sep. 27, 2022

(54) STORAGE BIN VENTILATION SYSTEM AND APPARATUS

(71) Applicant: SIOUX STEEL COMPANY, Sioux Falls, SD (US)

(72) Inventor: Brent J. Bloemendaal, Zionsville, IN (US)

(73) Assignee: Sioux Steel Company, Sioux Falls, SD (US)

( * ) Notice: Subject to any disclaimer, the term of this patent is extended or adjusted under 35 U.S.C. 154(b) by 367 days.

(21) Appl. No.: 16/811,614

(22) Filed: Mar. 6, 2020

Related U.S. Application Data

(60) Provisional application No. 62/815,804, filed on Mar. 8, 2019.

(51) Int. Cl.
*F26B 9/06* (2006.01)

(52) U.S. Cl.
CPC ..... *F26B 9/063* (2013.01); *F26B 9/066* (2013.01)

(58) Field of Classification Search
CPC ..... F26B 9/063; F26B 9/066
See application file for complete search history.

(56) References Cited

U.S. PATENT DOCUMENTS

| | | | |
|---|---|---|---|
| 822,547 | A | 6/1906 | Nicolson |
| 2,646,023 | A | 7/1953 | Virgil |
| 2,722,305 | A | 11/1955 | Mccabe |
| 2,763,362 | A | 9/1956 | Greaves |
| 2,801,137 | A | 7/1957 | Clay |
| 3,014,575 | A | 12/1961 | Klein |
| 3,035,718 | A | 5/1962 | Behlen |
| 3,065,996 | A | 11/1962 | Patz |
| 3,067,914 | A | 12/1962 | Ellaby |
| 3,175,676 | A | 3/1965 | Vander Schaaf |
| 3,181,715 | A | 5/1965 | Olson |
| 3,204,786 | A | 9/1965 | Kucera |

(Continued)

FOREIGN PATENT DOCUMENTS

| | | |
|---|---|---|
| CA | 2312068 | 12/2001 |
| FR | 1032110 | 6/1953 |

(Continued)

OTHER PUBLICATIONS

Grain Conditioning Equipment, brochure, edition date Jul. 2015, 12 pages, Sioux Steel Company, Sioux Falls, South Dakota.

(Continued)

*Primary Examiner* — Jessica Yuen
(74) *Attorney, Agent, or Firm* — Jeffrey A. Proehl; Woods, Fuller, Shultz & Smith, PC

(57) ABSTRACT

A bin ventilation apparatus and system may include a duct defining a duct interior and having an inboard end for orienting toward the bin and an outboard end for orienting away from the bin. The duct may have an inboard opening at the inboard end and a perimeter wall extending between the inboard and outboard ends. The perimeter wall may have an upper wall portion, a lower wall portion, and a pair of side wall portions about the duct interior. The apparatus may also include an air movement assembly mounted on the duct and being at least partially positioned in the duct interior between the inboard and outboard ends. The air movement assembly may include a motor and an impeller rotatable by the motor to move air through the duct.

20 Claims, 11 Drawing Sheets

(56) References Cited

U.S. PATENT DOCUMENTS

| | | | | |
|---|---|---|---|---|
| 3,228,514 | A | 1/1966 | Kucera | |
| 3,229,665 | A | 1/1966 | Baltz | |
| 3,229,827 | A | 1/1966 | Kucera | |
| 3,231,106 | A | 1/1966 | Bruecker | |
| 3,291,325 | A | 12/1966 | Henningson | |
| 3,297,146 | A | 1/1967 | Munger | |
| 3,338,636 | A | 8/1967 | Chapman | |
| 3,438,517 | A | 4/1969 | Steffen | |
| 3,451,567 | A | 6/1969 | Laidig | |
| 3,455,470 | A | 7/1969 | Kanagy | |
| 3,472,357 | A | 10/1969 | Strocker | |
| 3,486,643 | A | 12/1969 | Smith | |
| 3,532,232 | A | 10/1970 | Sukup | |
| 3,584,842 | A * | 6/1971 | Sukup | B01J 8/10 366/261 |
| 3,647,094 | A | 3/1972 | Jackson | |
| 3,828,916 | A | 8/1974 | Patz | |
| 3,838,780 | A | 10/1974 | Ridlehuber | |
| 3,908,840 | A | 9/1975 | Lambert | |
| 3,946,496 | A | 3/1976 | Sukup | |
| 3,946,861 | A | 3/1976 | Sandefur | |
| 3,974,908 | A | 8/1976 | Keichinger | |
| 3,982,329 | A * | 9/1976 | Dougherty | F26B 3/06 34/233 |
| 3,986,600 | A | 10/1976 | Pentith | |
| 4,009,520 | A * | 3/1977 | Sukup | F26B 9/063 34/233 |
| 4,022,335 | A | 5/1977 | Lambert | |
| RE29,309 | E | 7/1977 | Patterson | |
| RE29,386 | E | 9/1977 | Miksitz | |
| 4,057,151 | A | 11/1977 | Weaver | |
| 4,230,222 | A | 10/1980 | Clark | |
| 4,242,028 | A | 12/1980 | Van Dusen | |
| 4,256,029 | A * | 3/1981 | Steffen | A01F 25/08 34/233 |
| 4,306,490 | A * | 12/1981 | Kallestad | F26B 9/103 34/233 |
| 4,313,705 | A | 2/1982 | Jackson | |
| 4,329,105 | A | 5/1982 | Buschbom | |
| 4,451,192 | A | 5/1984 | Wood | |
| 4,516,898 | A | 5/1985 | Cantenot | |
| 4,578,012 | A | 3/1986 | Petit | |
| 4,583,903 | A | 4/1986 | Hutchison | |
| 4,585,385 | A | 4/1986 | Buschbom | |
| 4,619,330 | A | 10/1986 | Machnee | |
| 4,619,577 | A | 10/1986 | Swanson | |
| 4,621,968 | A | 11/1986 | Hutchison | |
| 4,669,941 | A | 2/1987 | West | |
| 4,655,666 | A | 4/1987 | Cantenot | |
| 4,658,911 | A | 4/1987 | Drever | |
| 4,762,220 | A | 8/1988 | Lutke | |
| 4,773,808 | A | 9/1988 | Fischer | |
| 4,775,278 | A | 10/1988 | Fischer | |
| 4,824,312 | A | 4/1989 | Schiltz | |
| 4,875,820 | A | 10/1989 | Lepp | |
| 4,998,855 | A | 3/1991 | Tschernatsch | |
| 5,088,871 | A | 2/1992 | Mellish | |
| 5,099,983 | A | 3/1992 | Valdez | |
| 5,180,272 | A | 1/1993 | Campbell | |
| 5,186,596 | A | 2/1993 | Boucher | |
| 5,203,802 | A | 4/1993 | Denis | |
| 5,540,533 | A | 7/1996 | Eskelinen | |
| 5,639,200 | A | 6/1997 | Jiskoot | |
| 5,769,590 | A | 6/1998 | Weikel | |
| 5,788,055 | A | 8/1998 | Stewart | |
| 5,944,168 | A | 8/1999 | Campbell | |
| 5,947,261 | A | 9/1999 | Baker | |
| 6,017,180 | A | 1/2000 | Wilham | |
| 6,039,647 | A | 3/2000 | Weikel | |
| 6,095,742 | A | 8/2000 | Campbell | |
| 6,203,261 | B1 | 3/2001 | South | |
| 6,254,329 | B1 | 7/2001 | Sukup | |
| 6,280,331 | B1 | 8/2001 | Tuttlebee | |
| 6,281,610 | B1 | 8/2001 | Kliman | |
| 6,499,930 | B1 | 12/2002 | Dixon | |
| 6,619,473 | B2 | 9/2003 | Romeo | |
| 6,640,451 | B1 | 11/2003 | Vinarcik | |
| 6,672,342 | B2 | 1/2004 | Nussbaumer | |
| 6,948,902 | B2 | 9/2005 | Hanig | |
| 7,210,538 | B2 | 5/2007 | Gust | |
| 7,544,031 | B2 | 6/2009 | Kaeb | |
| 7,588,405 | B2 | 9/2009 | Johnson | |
| 7,967,542 | B2 | 6/2011 | Epp | |
| 8,657,025 | B2 | 2/2014 | Thompson | |
| 8,770,388 | B1 | 7/2014 | Chaon | |
| 9,120,633 | B2 | 9/2015 | Ahlen | |
| 9,199,807 | B1 | 12/2015 | Schuelke | |
| 9,288,946 | B1 | 3/2016 | Schuld | |
| 9,290,335 | B1 | 3/2016 | Witt | |
| 9,862,545 | B2 | 1/2018 | Kaeb | |
| 10,220,420 | B2 | 3/2019 | Witt | |
| 10,227,188 | B1 | 3/2019 | Chaon | |
| 10,238,042 | B2 | 3/2019 | Ahlen | |
| 10,442,641 | B2 | 10/2019 | Nelson | |
| 2004/0146381 | A1 | 7/2004 | Hanson | |
| 2004/0213650 | A1 | 10/2004 | Epp | |
| 2005/0254922 | A1 | 11/2005 | Berraeu | |
| 2005/0263372 | A1 | 12/2005 | Hollander | |
| 2006/0245864 | A1 | 11/2006 | Epp | |
| 2006/0285942 | A1 | 12/2006 | Fridgen | |
| 2009/0041566 | A1 | 2/2009 | Lambertini | |
| 2010/0239399 | A1 | 9/2010 | Hoogestraat | |
| 2013/0064629 | A1 | 3/2013 | Schuelke | |
| 2013/0216341 | A1 | 8/2013 | Luster | |
| 2015/0225190 | A1 | 8/2015 | Witt | |
| 2016/0052719 | A1 | 2/2016 | Ganzer | |

FOREIGN PATENT DOCUMENTS

| | | |
|---|---|---|
| FR | 2309442 | 11/1976 |
| FR | 2348132 | 11/1977 |
| FR | 2630620 | 11/1989 |
| GB | 1327791 | 8/1973 |
| GB | 2069448 | 8/1981 |
| GB | 2076357 | 12/1981 |

OTHER PUBLICATIONS

Sudenga Industries, Inc., Press Release, Nov. 1, 2004.

G & G Manufacturing SC-X4" Ratchet Slip Clutches, download date May 31, 2015.

Wen-Bin Du,Qun Fang, Qiao-Hong He, and, and Zhao-Lun Fang. "High-Throughput Nanoliter Sample Introduction Microfluidic Chip-Based Flow Injection Analysis System with Gravity-Driven Flows", Analytical Chemistry 2005 77 (5), pp. 1330-1337, Mar. 1, 2005.

Jayas, Digvir S., and Noel DG White. "Storage and drying of grain in Canada: low cost approaches." Food control 14.4 (2003); pp. 255-261, Jan. 5, 2003.

* cited by examiner

STORAGE BIN VENTILATION SYSTEM AND APPARATUS

REFERENCE TO RELATED APPLICATIONS

This application claims the benefit of the priority of U.S. Provisional Patent Application No. 62/815,804, filed Mar. 8, 2019, which is incorporated by reference in its entirety.

BACKGROUND

Field

The present disclosure relates to ventilation systems and more particularly pertains to a new storage bin ventilation system and apparatus for providing ventilation to the interior of a storage bin with a highly integrated configuration.

SUMMARY

In one aspect, the present disclosure relates to a bin ventilation apparatus for moving air into a bin interior of a storage bin. The bin ventilation apparatus may comprise a duct defining a duct interior, with the duct having an inboard end for orienting toward the bin and an outboard end for orienting away from the bin. The duct may have an inboard opening at the inboard end, and may comprise a perimeter wall extending between the inboard end and the outboard end. The perimeter wall may have an upper wall portion above the duct interior and a lower wall portion below the duct interior, and a pair of side wall portions on opposite sides of the duct interior being united with the upper and lower wall portions. The apparatus may additionally comprise an air movement assembly mounted on the duct and being at least partially positioned in the duct interior between the inboard and outboard ends, and the air movement assembly may comprise a motor and an impeller rotatable by the motor to move air through the duct.

In another aspect, the disclosure relates to a system which may comprise a storage bin having a peripheral wall defining a bin interior with a slot opening being formed in the peripheral wall. The peripheral wall has an outer surface which is substantially cylindrical about a vertical axis of the storage bin. The system may further comprise a bin ventilation apparatus for moving air into the bin interior of the storage bin. The bin ventilation apparatus may comprise a duct defining a duct interior with the duct having an inboard end oriented toward the bin and an outboard end oriented away from the bin. The duct having an inboard opening at the inboard end, and a perimeter wall extending between the inboard end and the outboard end. The perimeter wall may have an upper wall portion above the duct interior and a lower wall portion below the duct interior. The perimeter wall may further have a pair of side wall portions on opposite sides of the duct interior and may be united with the upper and lower wall portions. The bin ventilation apparatus may also comprise an air movement assembly mounted on the duct and being at least partially positioned in the duct interior between the inboard and outboard ends. The air movement assembly may comprise a motor and an impeller rotatable by the motor to move air through the duct. The ventilation apparatus may comprise an interface flange that forms an interface between the duct and the peripheral wall of the bin, and may be located at the inboard end of the duct.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
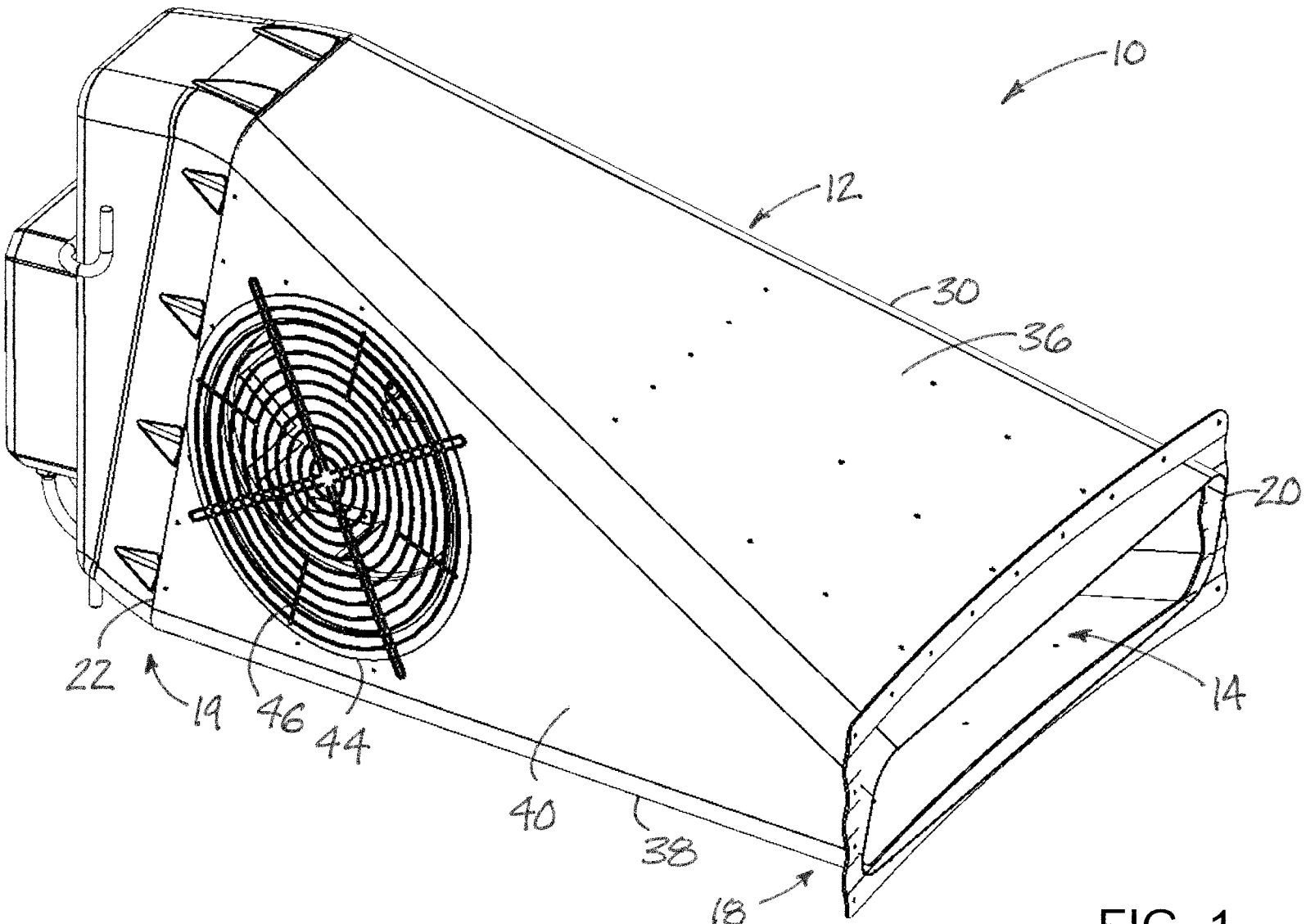
FIG. 1 is a schematic first side perspective view of a new storage bin ventilation apparatus according to the present disclosure.
Figure 2:
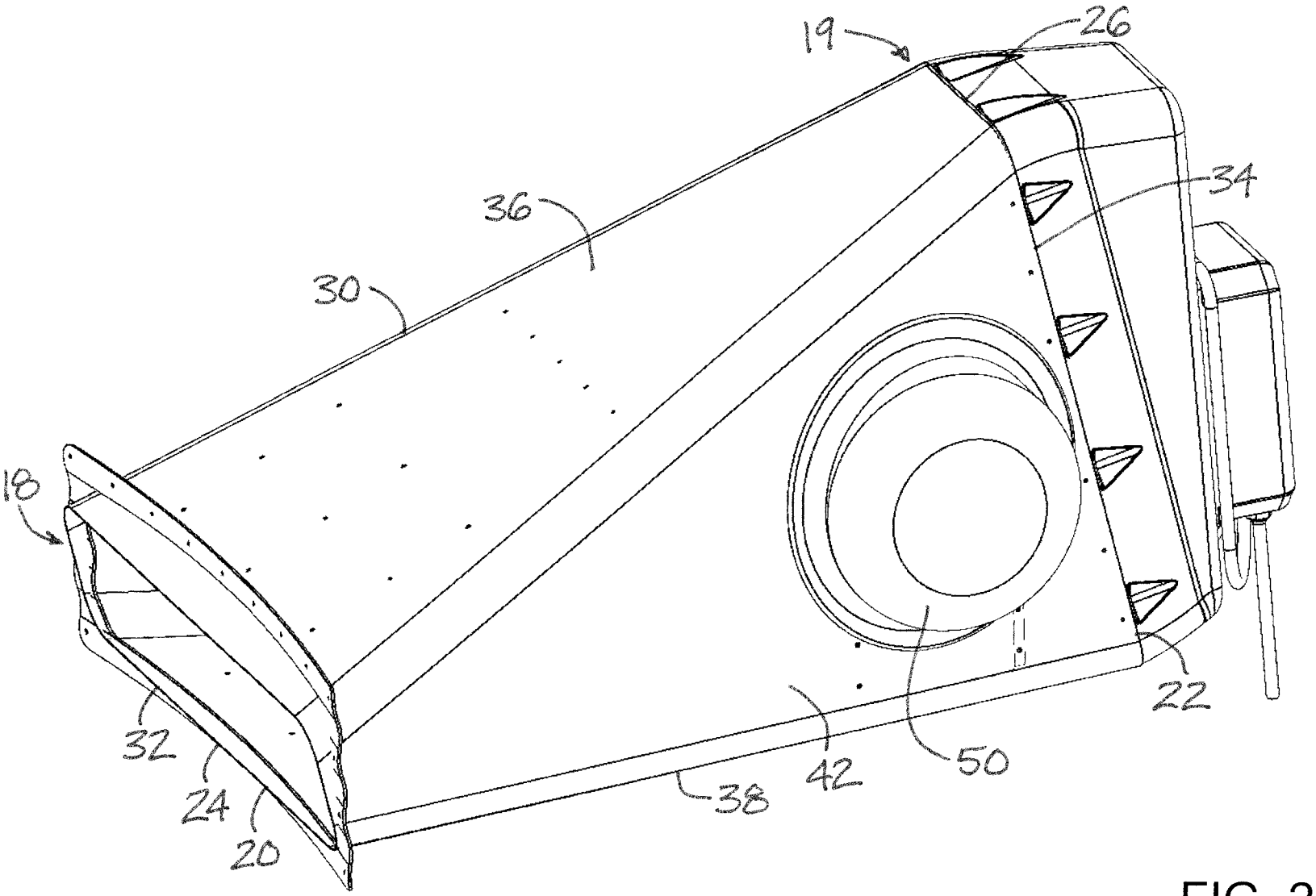
FIG. 2 is a schematic second side perspective view of the storage bin ventilation apparatus, according to an illustrative embodiment.
Figure 3:
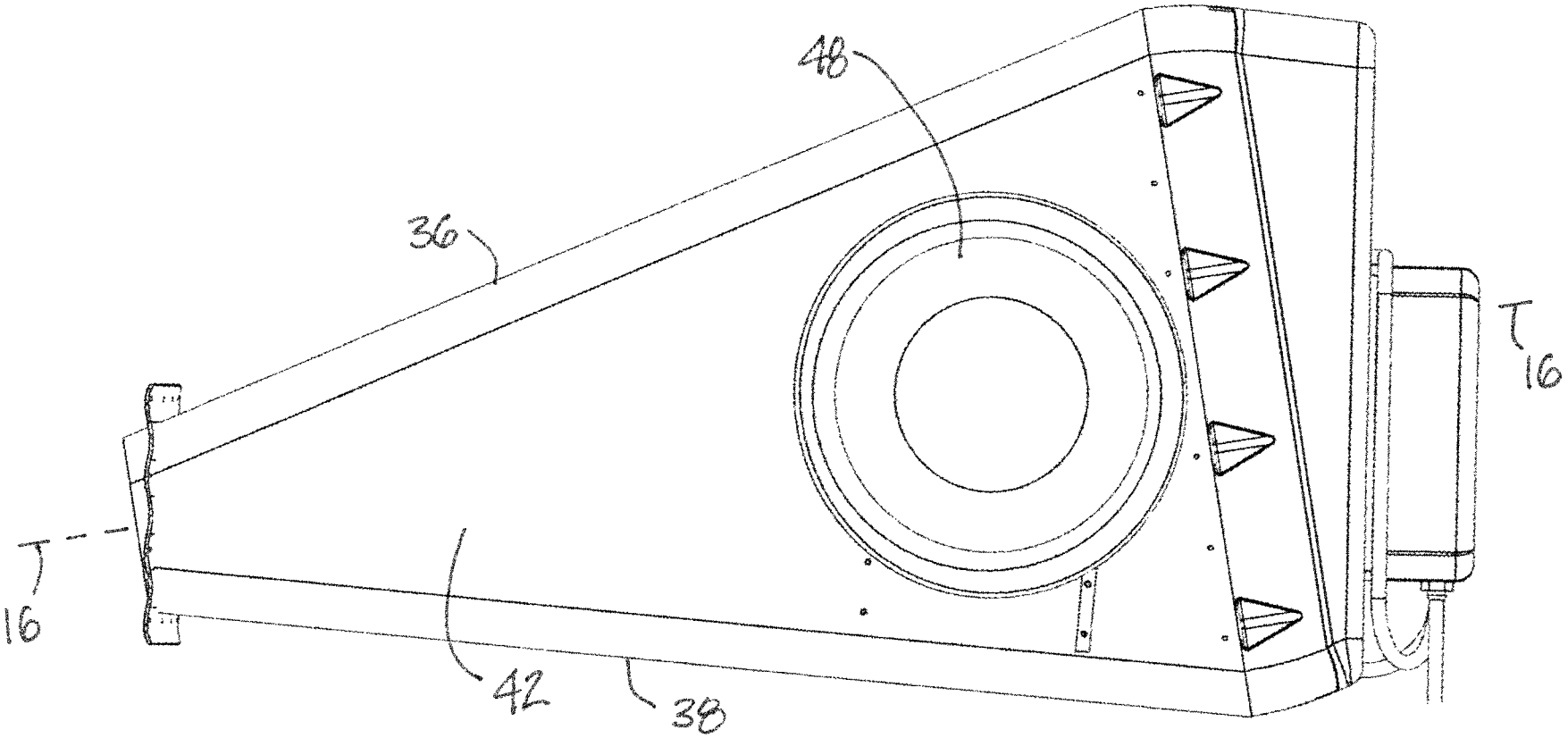
FIG. 3 is a schematic first side view of the storage bin ventilation apparatus, according to an illustrative embodiment.
Figure 4:
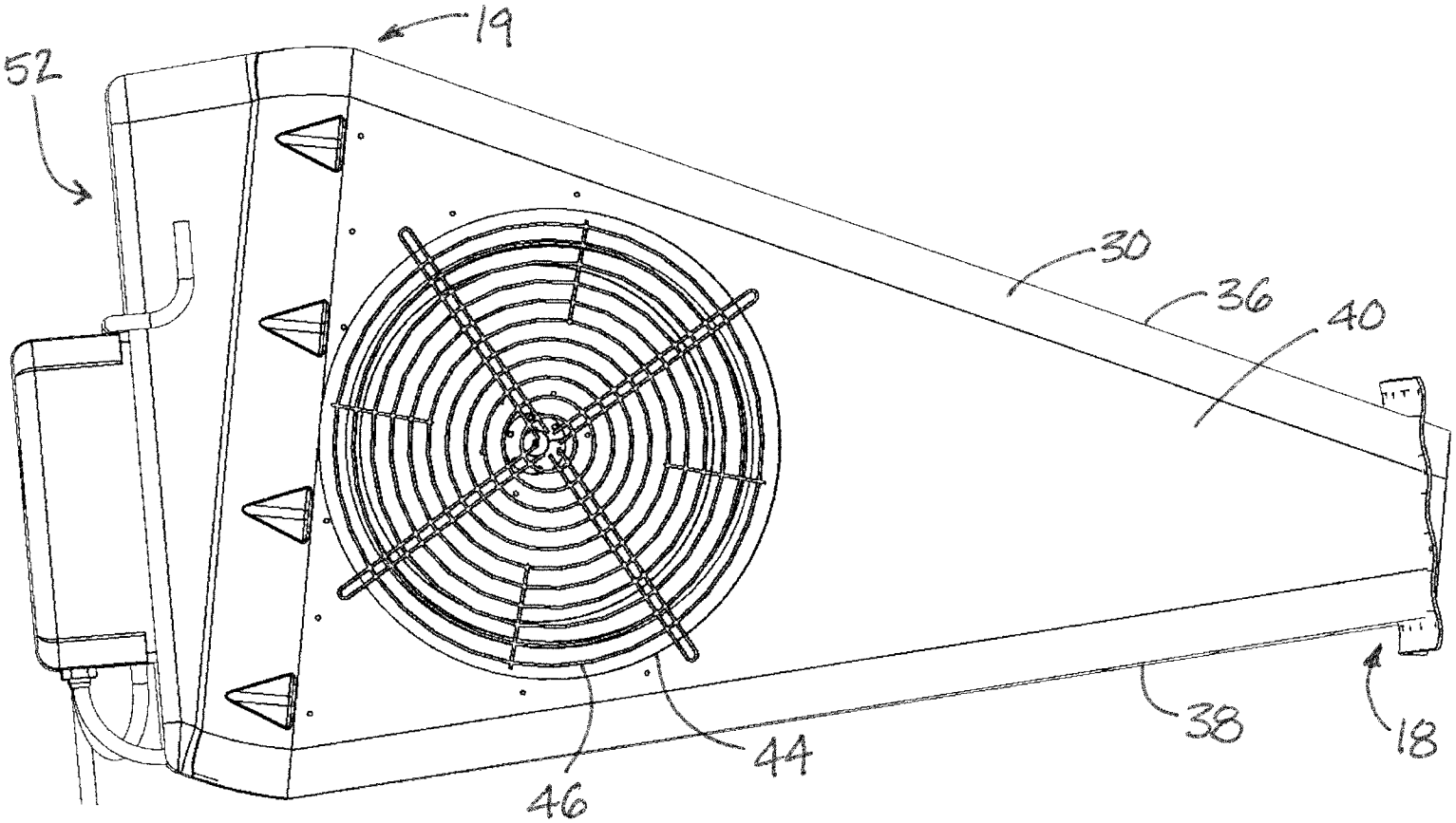
FIG. 4 is a schematic second side view of the storage bin ventilation apparatus, according to an illustrative embodiment.
Figure 5:
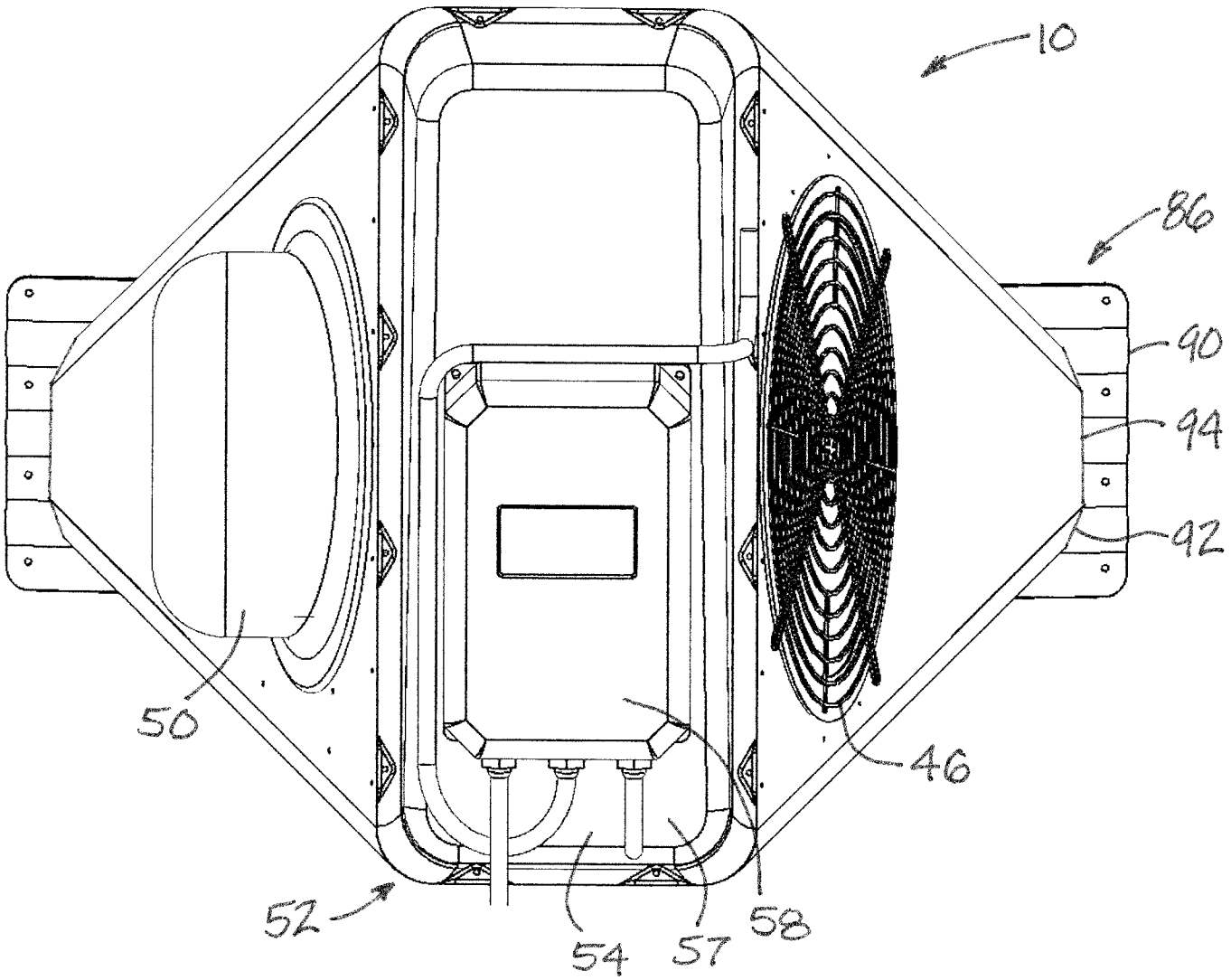
FIG. 5 is a schematic inboard end view of the storage bin ventilation apparatus, according to an illustrative embodiment.
Figure 6:
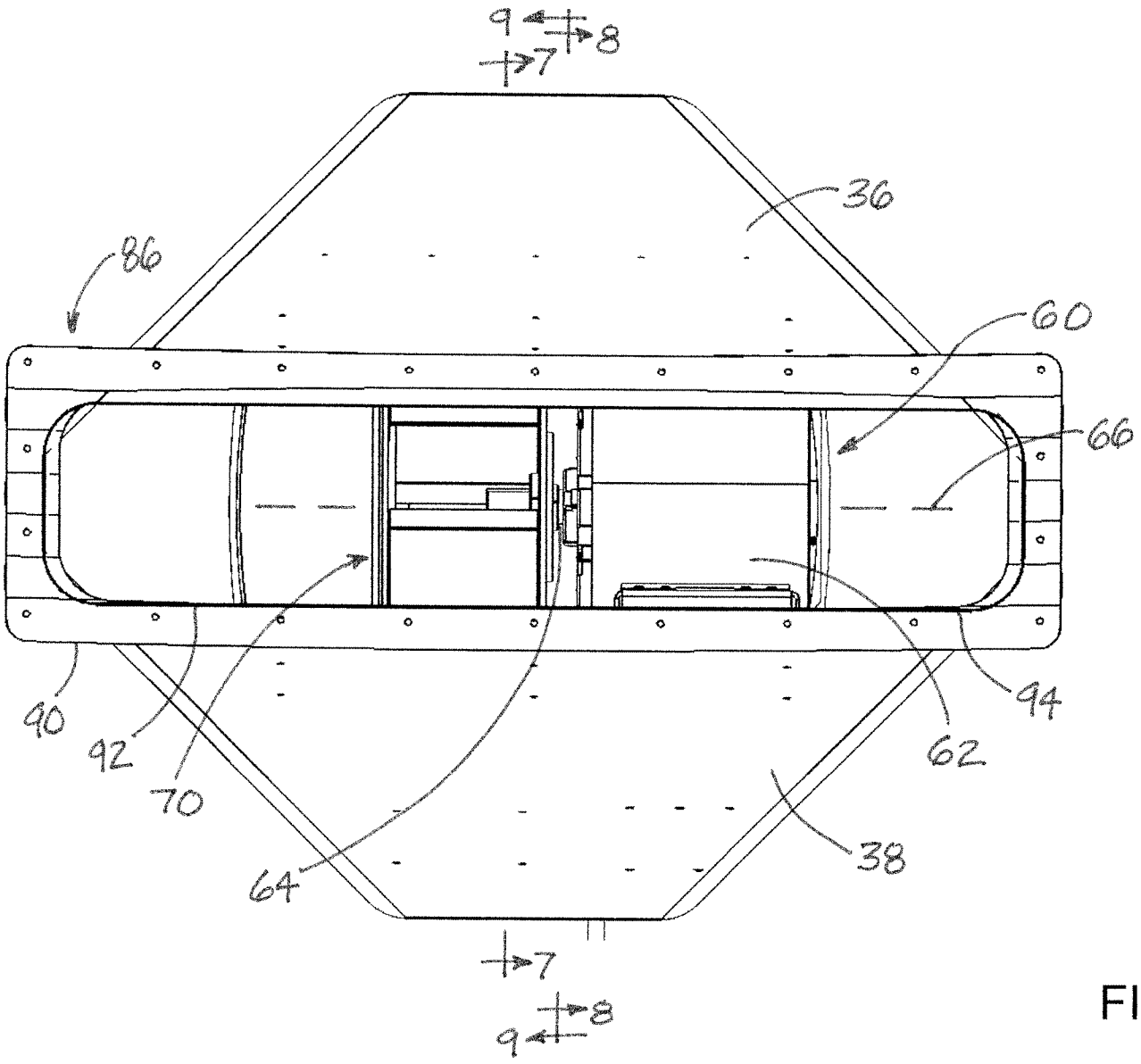
FIG. 6 is a schematic inboard end view of the storage bin ventilation apparatus, according to an illustrative embodiment.
Figure 7:
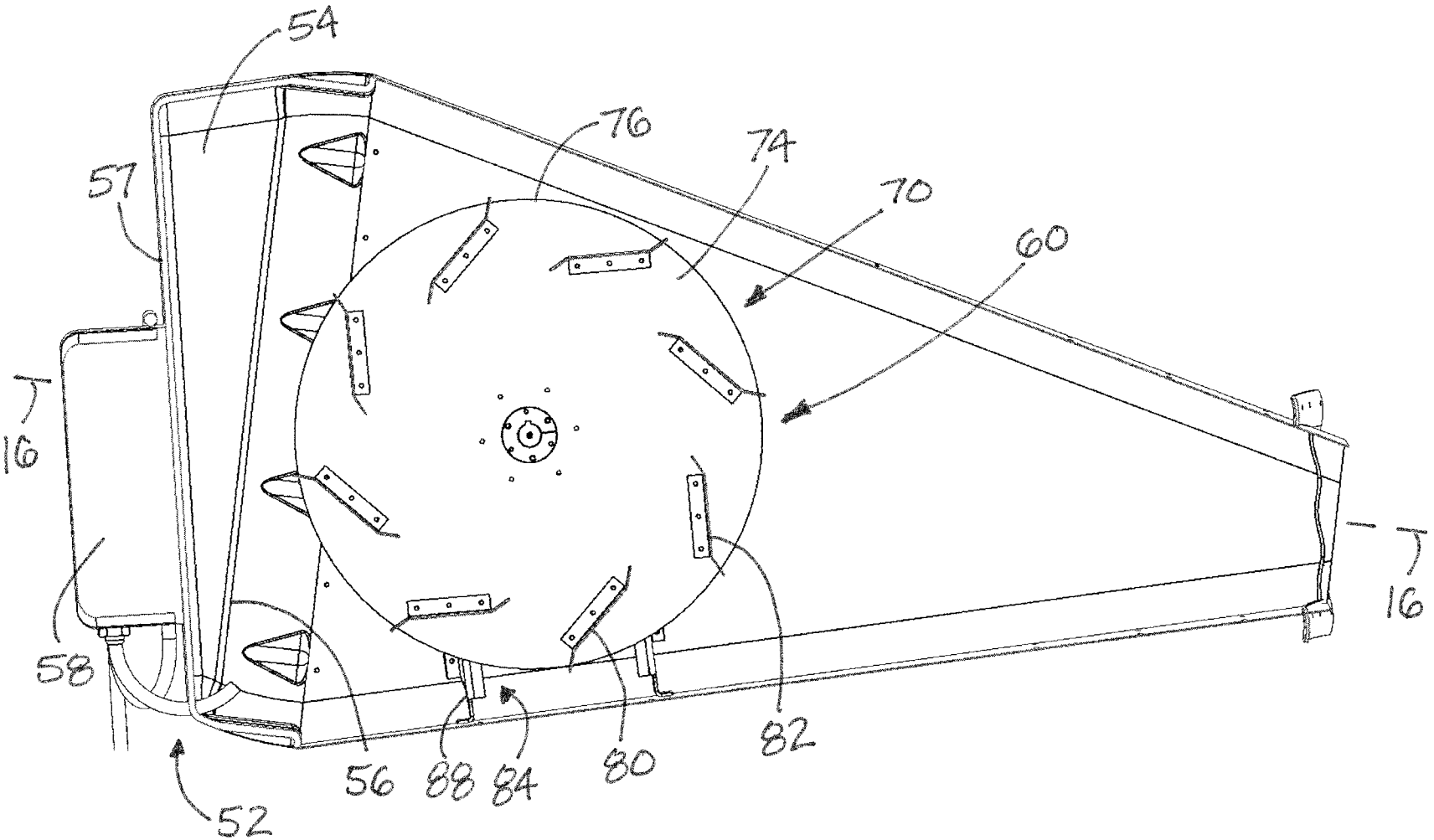
FIG. 7 is a schematic side sectional view of the storage bin ventilation apparatus taken along line 7-7 of FIG. 6, according to an illustrative embodiment.
Figure 8:
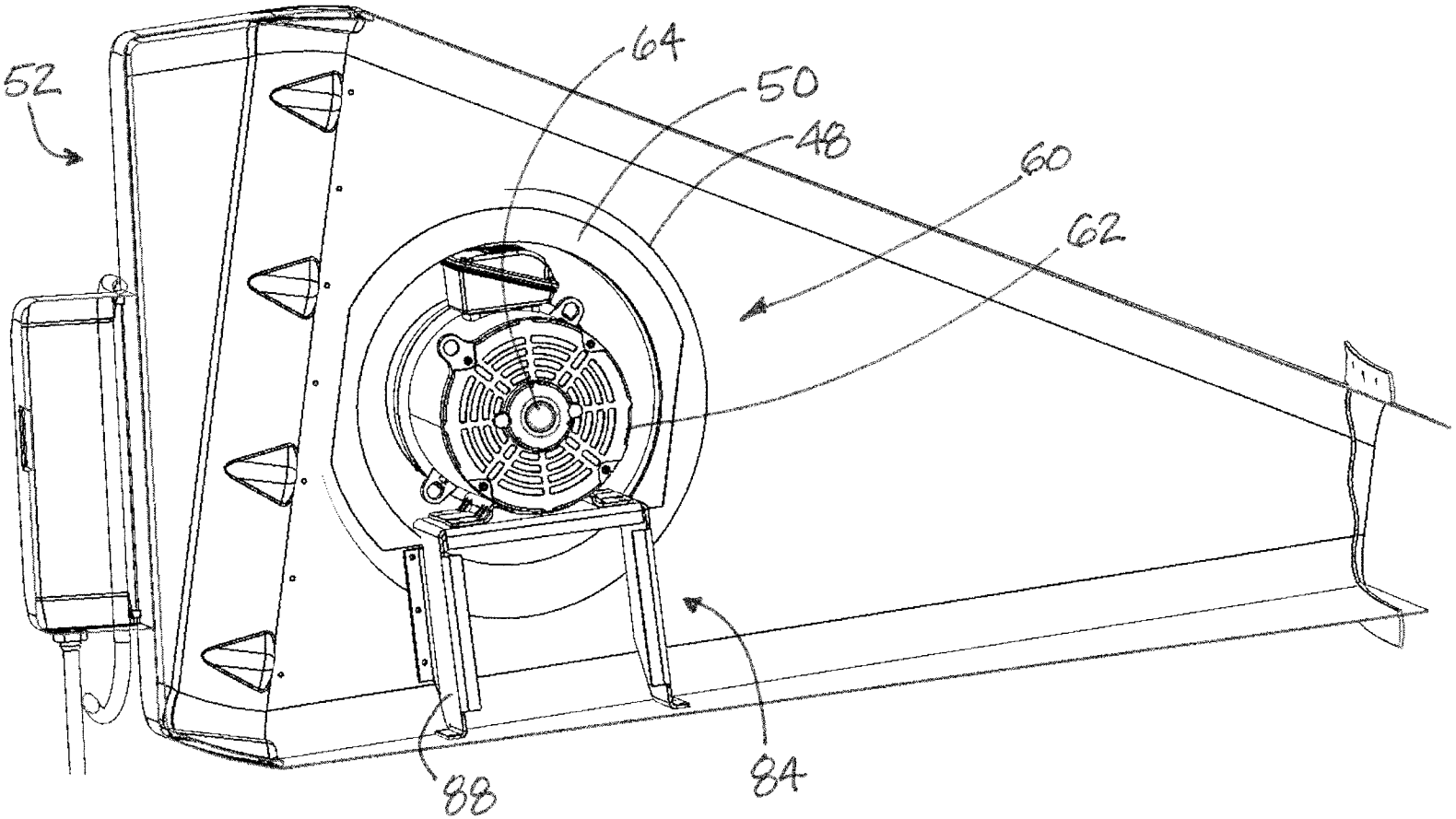
FIG. 8 is a schematic side sectional view of the storage bin ventilation apparatus taken along line 8-8 of FIG. 6, according to an illustrative embodiment.
Figure 9:
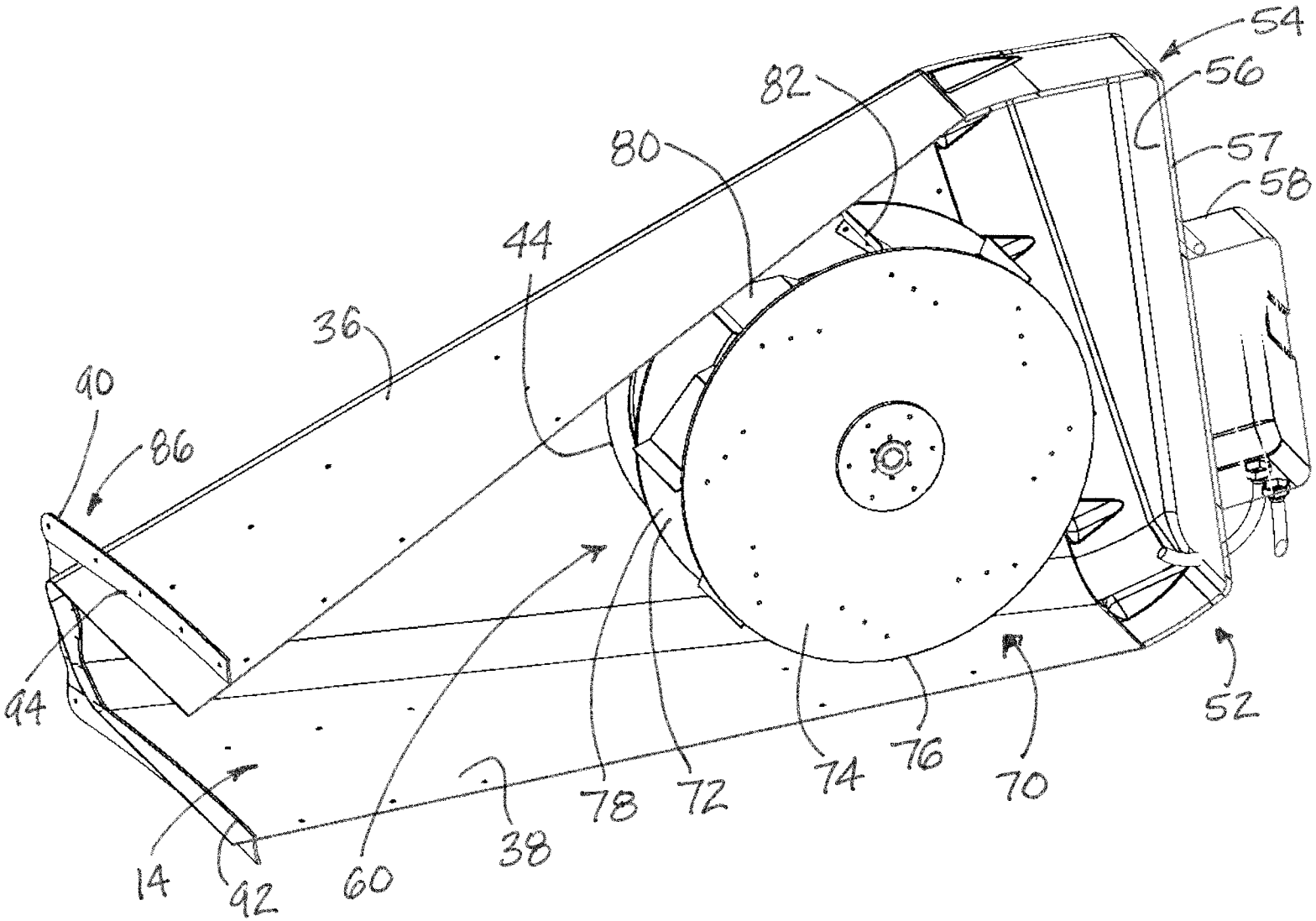
FIG. 9 is a schematic side sectional perspective view of the storage bin ventilation apparatus taken along line 9-9 of FIG. 6, according to an illustrative embodiment.
Figure 10:
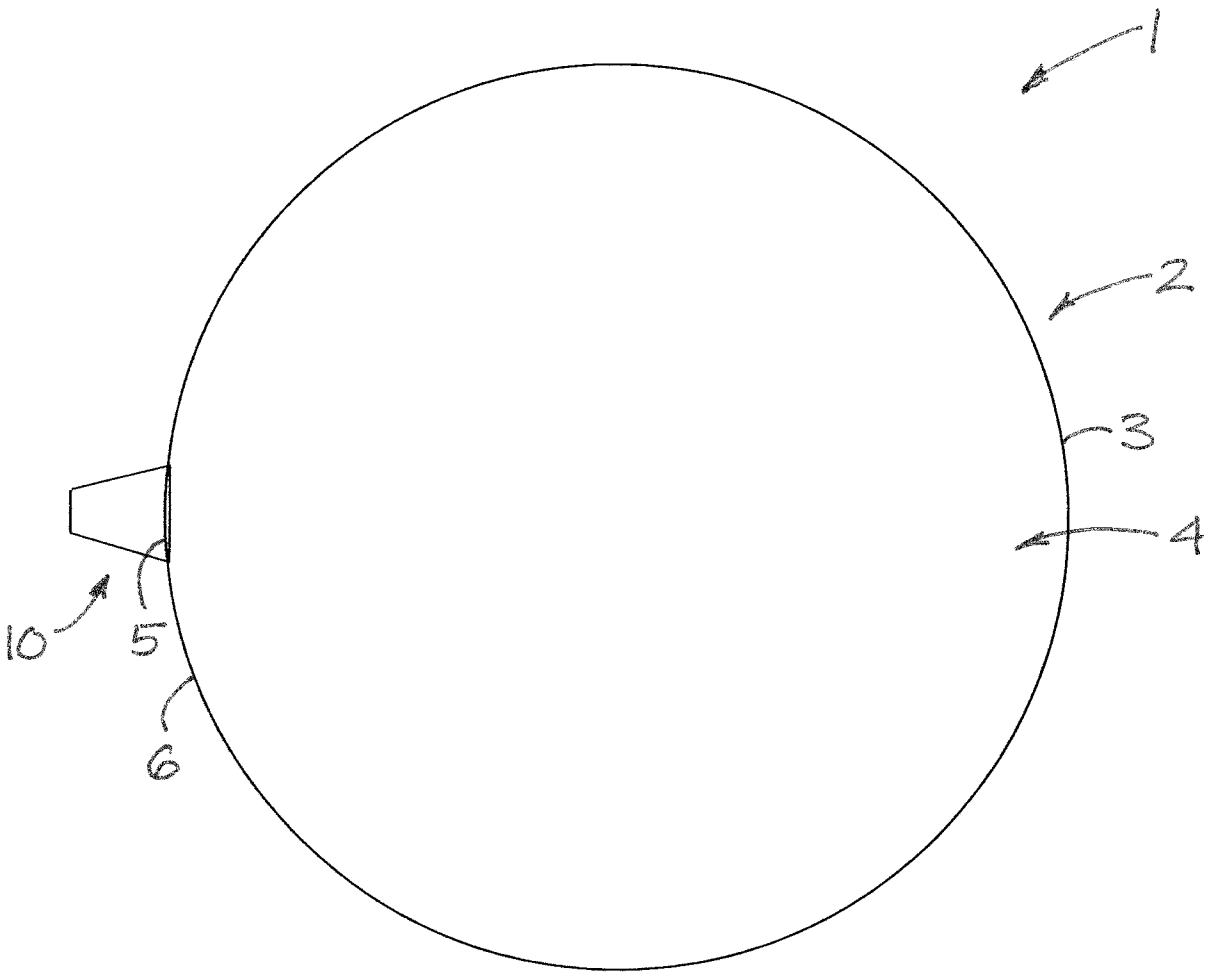
FIG. 10 is a schematic top diagrammatic view of the storage bin and the ventilation apparatus, according to an illustrative embodiment.
Figure 11:
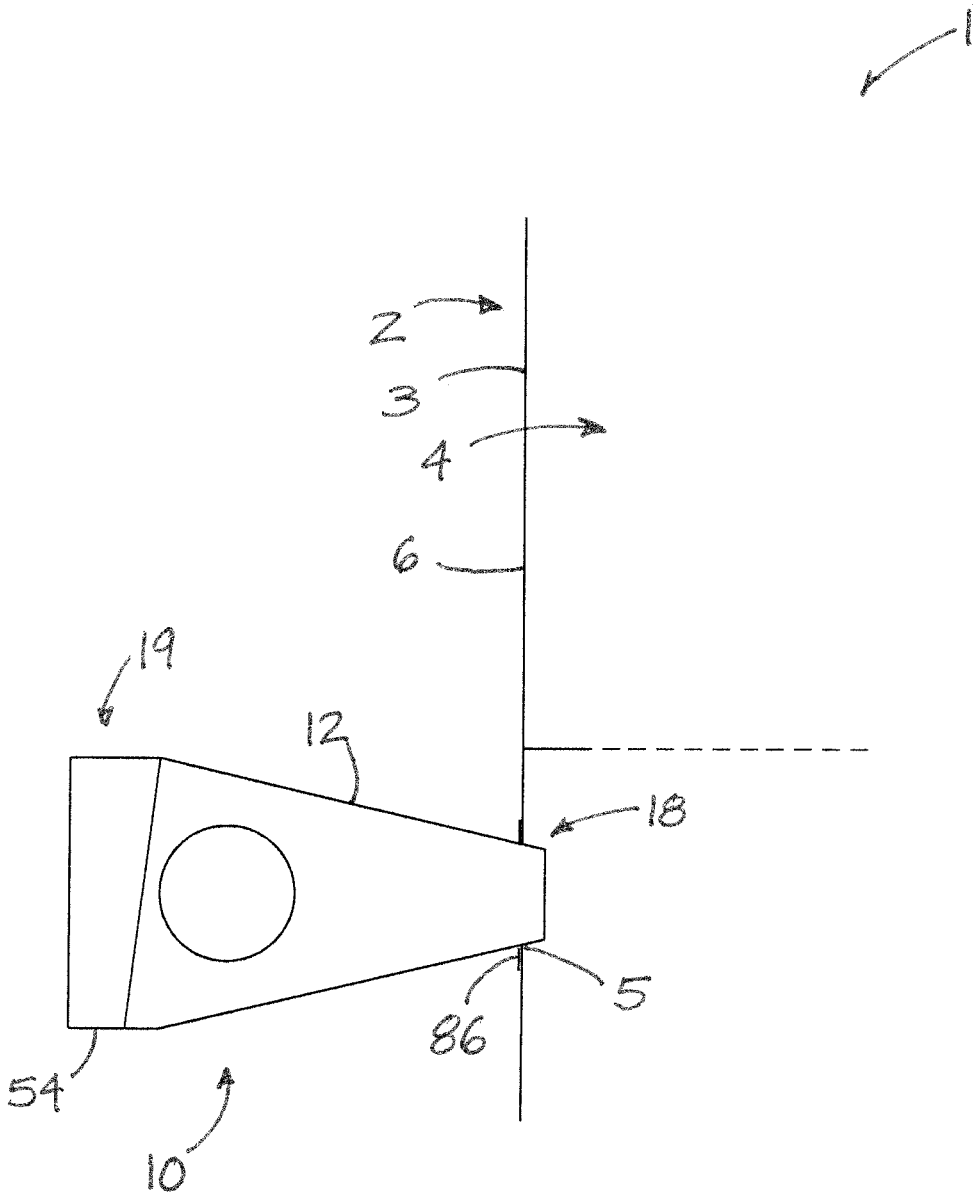
FIG. 11 is a schematic side diagrammatic view of the storage bin and the ventilation apparatus, according to an illustrative embodiment.

With reference now to the drawings, and in particular to FIGS. 1 through 11 thereof, a new a new storage bin ventilation system and apparatus embodying the principles and concepts of the disclosed subject matter will be described.

Ventilation systems for storage bins are generally employed for conditioning (e.g., drying) the contents of the bin to a desired state. Storage bins have a peripheral wall which is typically cylindrical in shape with a circular profile in a horizontal plane. Differences in the capacities of storage bins are typically a function of the diameter of the peripheral wall in the horizontal plane as well as, to a lesser degree, the height of the peripheral wall.

The applicants have recognized that installation of known storage bin ventilation systems typically utilize a fan apparatus of suitable air flow capacity and generic construction, and a transitional duct custom-built for the configuration of the particular storage bin to be ventilated. Such an approach typically requires a significant amount of fabrication to be performed in the field at the site of the bin to adapt the ventilation apparatus to the conditions at the bin site, including, for example, the diameter size of the peripheral wall of the bin and the elevation of the ground surrounding the peripheral wall of the bin. Such fabrication tasks increase the time and labor involved in the installation process, and may result overall in a more costly ventilation apparatus.

The applicants have thus developed a bin ventilation apparatus which typically integrates the fan apparatus and the transitional duct which may advantageously provide a simpler installation process across a variety of storage bin configurations without requiring significant adaptation fabrication, among other advantages.

In one aspect, the disclosure relates to a system 1 which may include a storage bin 2 which has the peripheral wall 3 which defines a bin interior 4 in which the material to be stored is positioned. Typically, the peripheral wall 3 has a floor which may be perforated in a manner that supports the contents of the bin in the bin interior while allowing air to pass upwardly through the floor from a subfloor chamber to the bin interior. Thus, air forced into the subfloor chamber escapes the chamber through the perforated floor into the bin interior and passes through the contents of the bin, such as between the particles forming the contents of the bin. A slot opening 5 may be formed in the peripheral wall 3 of the bin, and the slot opening may be in fluid communication with the subfloor chamber such that air may be introduced into the subfloor chamber of the bin by forcing the air forced through the slot opening. The peripheral wall 3 has an outer surface 6 which may be substantially cylindrical in shape about a vertical axis located substantially centrally in the bin interior for of the storage bin. Often the peripheral wall is formed of a corrugated material (e.g., galvanized steel) and as a result the outer surface 6 of the wall 3 undulates or is undulated with a plurality of peaks and valleys that extend horizontally about the exterior of the bin.

In another aspect, the disclosure relates to a bin ventilation apparatus 10 as an element of the system 1 or as an element independent of the system 1. The bin ventilation apparatus 10 may be configured to move air into the bin interior of the storage bin, such as through the slot opening 5 and into the subfloor chamber so that the air is forced through the perforations in the bin floor and into the bin interior 4.

The bin ventilation apparatus 10 may include a duct 12 which defines a duct interior 14 through which air or another gas is moved. The duct 12 may be elongated along a longitudinal axis 16 which may be oriented substantially perpendicular to the outer surface 6 of the peripheral wall 3 of the bin when the apparatus is mounted to the bin for operation. The duct 12 may have an inboard end 18 for orienting toward the bin and an outboard end 19 for orienting away from the bin. The inboard 18 and outboard 19 ends may be spaced from each other along the longitudinal axis 16. The duct may have an inboard opening 20 at the inboard end 18, and an outboard opening 22 at the outboard end 19. The inboard opening 20 may have an inboard perimeter 24 which forms the opening 20, and the outboard opening 22 may have an outboard perimeter 26 which forms the opening 22.

The duct 12 of the ventilation apparatus 10 may include a perimeter wall 30 which extends between the inboard 18 and outboard 19 ends of the duct. The perimeter wall may form the inboard 20 and outboard 22 openings of the duct. The perimeter wall may have an inboard edge 32 which forms the inboard opening 20 of the duct and an outboard edge 34 which forms the outboard opening 22 of the duct. The perimeter wall 30 may have an upper wall portion 36 generally located above the duct interior 14 and a lower wall portion 38 generally located below the duct interior. The upper 36 and lower 38 wall portions may be substantially planar in shape, and in some embodiments may converge toward the inboard end 18 and diverge toward the outboard end 19. The upper and lower wall portions may each have a width measured in a direction substantially perpendicular to the longitudinal axis 16, and in some embodiments the width of the upper and lower wall portions may be relatively smaller toward the outboard end 19 and relatively larger toward the inboard end 18.

The perimeter wall 30 may also include a pair of side wall portions 40, 42 generally located on opposite sides of the upper 36 and lower 38 wall portions and the side wall portions are united to the wall portions 36, 38 to form the perimeter of the perimeter wall. In some embodiments, the side wall portions may be oriented substantially perpendicular to the upper and lower wall portions. The opposite side wall portions 40, 42 may also be substantially planar in shape, and in some embodiments may converge toward the outboard end 19 of the duct and diverge toward the inboard end 18. The opposite side wall portions 40, 42 may each have a width measured in a direction substantially perpendicular to the longitudinal axis 16, and in some embodiments the width of the opposite side wall portions may be relatively smaller toward the inboard end 18 and relatively larger toward the outboard end 19.

The duct 12 may have an intake opening 44 through which air may be introduced into the duct interior 14. Illustratively, the intake opening 44 may be located in a first one 40 of the side wall portions of the perimeter wall 30. The intake opening 44 may be located toward the outboard end 19 of the duct, and in some embodiments a grate 46 may be positioned over the intake opening 44 to limit movement of relatively larger items through the intake opening. The duct 12 may also have a motor access opening 48 which provides access to a motor located in the duct interior 14, as well as optionally providing additional clearance or space for such a motor. Illustratively, the motor access opening 48 may be located in a second one 42 of the side wall portions of the perimeter wall 30, and may be located toward the outboard end 19 of the duct. In some embodiments, the motor access cover 50 may be positioned over the motor access opening 48 and may be mounted on the perimeter wall 30 of the duct, optionally in a manner that permits removal of the cover 50 from the duct.

The bin ventilation apparatus 10 may also include a cap assembly 52 which is positioned at the outboard end 19 of the duct and may function to close or otherwise obstruct the outboard opening 22 of the duct. The cap assembly 52 may comprise a cap 54 which may be positioned adjacent to, and optionally engage, the outboard edge 34 about the outboard opening. The cap 54 may have an inner side 56 which is directed toward the duct interior 14 and an outer side 57 which is opposite of the inner side 56 on the cap and thus directed away from the duct interior. In some embodiments, a power controller 58 may be mounted on the outer side 57 of the cap.

The apparatus 10 may also include an air movement assembly 60 which is mounted on the duct 12, and may be effectively integrated with the duct. The air movement assembly 60 may be at least partially positioned in the duct interior 14, and in at least some embodiments substantially all major elements of the apparatus 10 may be contained within the duct interior 14. The air movement assembly 60 may include a motor 62 which may be positioned in the duct interior 14 and may be located toward the outboard end 19 of the duct. In some embodiments, the motor 62 may partially protrude from the duct interior 14 through the motor access opening, although optionally the motor may be fully contained within the duct interior. The motor 62 may have a rotating motor shaft 64 which is rotatable about a rotation axis 66, and the rotation axis may be oriented substantially perpendicular to the longitudinal axis 16 of the duct.

The air movement assembly 60 may also include an impeller 70 which is configured to move air through the duct and the duct interior. The impeller may be in fluid communication with the intake opening 44 of the duct, and may be positioned adjacent to the intake opening. The impeller 70 may be rotated by the motor 62 and may be connected to the motor shaft 64, and in some embodiments the impeller 70 may be mounted to the motor shaft. In the illustrative embodiment, the impeller 70 is a centrifugal impeller. The impeller 70 may include a pair of impeller plates 72, 74 which are connected to the motor shaft 64, and in some embodiments may be mounted on the motor shaft. The impeller plates may each have a perimeter edge 76 which may be substantially circular in shape, and each of the plates may have a plate face 78 which may be substantially planar in shape and the plate faces of the plates may be positioned in opposition to each other. The impeller 70 may also include a plurality of blades 80, 82 which are mounted on the impeller plates and may be arrayed along the respective perimeter edges 76 of the impeller plates and may be spaced from each other along the perimeter edge.

The air movement assembly may also include a motor support 84 which supports the motor 62 in the duct interior 14. The motor support 84 may be mounted on the duct, and may be mounted on the perimeter wall 30 such as on the lower wall portion 38 of the wall 30. The motor support 84 may have at least one support leg 88 which extends from the perimeter wall to the location of the motor 62, which may be toward the cross-sectional center of the duct interior 14.

The bin ventilation apparatus may also include an interface flange 86 which is configured to form an interface between the duct 12 and the peripheral wall 3 of the bin 2. The interface flange 88 may be located at or toward the inboard end 18 of the duct and in some implementations a portion of the duct 12 adjacent to the inboard end 18 may protrude through the interface flange. The flange 86 may have an outer peripheral edge 90 and an inner edge 92 which forms a duct opening 94 through which a portion of the duct extends. The interface flange 86 may be customized or otherwise adapted for the particular configuration of the peripheral wall 3 of the bin, such as the shape of the outer surface 6 of the peripheral wall about the slot opening 5 through the peripheral wall. The interface flange 86 may thus be formed from material having corrugations or have an undulating surface which is suitable for positioning adjacent to or in contact with the outer surface 6 of the peripheral wall 30 of the bin.

In some advantageous embodiments, the length of the inboard perimeter 24 may be substantially equal to the outboard perimeter 26. As a result, the perimeter wall 30 of the duct may be formed by a single piece of substantially rectangular sheet material between the inboard 18 and outboard 19 ends of the duct, which may reduce the number of operations needed to be performed upon the sheet material to form the duct, such as punching or otherwise cutting features into the perimeter of the material blank utilized to form the perimeter wall 30.

The generally integrated and highly self-contained character of the bin ventilation apparatus 10 may have a number of advantages including, for example, a simpler construction compared to apparatus utilizing separate and distinct transitional ducts and fan housings, a more compact footprint which may enhance the ability to "hang" or otherwise suspend and support the apparatus on the peripheral wall of the bin without, for example, having to create or install a support pad on the ground adjacent to the bin. Moreover, the characteristics of the air flow through the apparatus 10 can be better tuned than apparatus utilizing separate transition ducts and fan housings.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A bin ventilation apparatus for moving air into a bin interior of a storage bin, the bin ventilation apparatus comprising:

a duct defining a duct interior, the duct having an inboard end for orienting toward the bin and an outboard end for orienting away from the bin, the duct having an inboard opening at the inboard end, the duct additionally has an outboard opening at the outboard end of the duct, the duct comprising a perimeter wall extending between the inboard end and the outboard end, the perimeter wall having a first set of wall portions including an upper wall portion above the duct interior and a lower wall portion below the duct interior, the perimeter wall further having a second set of wall portions including a pair of side wall portions on opposite sides of the duct interior and being united with the upper and lower wall portions of the first set of wall portions;

an air movement assembly mounted on the duct, the air movement assembly including a motor and an impeller rotatable by the motor to move air through the duct, the impeller being positioned in the duct interior between the inboard and outboard ends of the duct;

wherein the wall portions of one said set of wall portions converge toward the inboard end of the duct and the wall portions of another said set of wall portions diverge toward the inboard end of the duct such that the impeller is positioned between the set of converging wall portions and the set of diverging wall portions.

2. The apparatus of claim 1 wherein the duct additionally has an outboard opening at the outboard end of the duct; and wherein the inboard opening of the duct has an inboard perimeter and the outboard opening of the duct has an outboard perimeter, a length of the inboard perimeter being substantially equal to a length of the outboard perimeter.

3. The apparatus of claim 1 wherein the upper and lower wall portions of the perimeter wall converge toward the inboard end of the duct and diverge toward the outboard end of the duct.

4. The apparatus of claim 1 wherein the opposite side wall portions of the perimeter wall converge toward the outboard end of the duct and diverge toward the inboard end of the duct.

5. The apparatus of claim 1 wherein the upper and lower wall portions of the perimeter wall each have a width, the width of the upper and lower wall portions being relatively smaller toward the outboard end of the duct and relatively larger toward the inboard end of the duct.

6. The apparatus of claim 5 wherein the opposite side wall portions of the perimeter wall each have a width, the width of the opposite side wall portions being relatively smaller toward the inboard end and relatively larger toward the outboard end.

7. The apparatus of claim 6 wherein the upper and lower wall portions and the opposite side wall portions are substantially planar.

8. The apparatus of claim 6 wherein the perimeter wall of the duct is formed between the inboard and outboard ends by a single piece of sheet material.

9. The apparatus of claim 1 wherein the impeller of the air movement assembly is positioned in the duct interior substantially entirely between the inboard and outboard ends of the duct.

10. The apparatus of claim 1 wherein the duct of the air movement assembly has a longitudinal axis extending between the inboard and outboard openings of the duct; and wherein the impeller has a rotation axis oriented substantially perpendicular to the longitudinal axis of the duct.

11. A bin ventilation apparatus for moving air into a bin interior of a storage bin, the bin ventilation apparatus comprising:

a duct defining a duct interior, the duct having an inboard end for orienting toward the bin and an outboard end for orienting away from the bin, the duct having an inboard opening at the inboard end, the duct comprising a perimeter wall extending between the inboard end and the outboard end, the perimeter wall having an upper wall portion above the duct interior and a lower wall portion below the duct interior, the perimeter wall further having a pair of side wall portions on opposite sides of the duct interior and being united with the upper and lower wall portions; and an air movement assembly mounted on the duct and being at least partially positioned in the duct interior between the inboard and outboard ends, the air movement assembly comprising a motor and an impeller rotatable by the motor to move air through the duct;

wherein the duct additionally has an outboard opening at the outboard end of the duct;

a cap assembly positioned at the outboard end of the duct to close the outboard opening of the duct.

12. The apparatus of claim 11 wherein an intake opening is formed in one of the wall portions of the perimeter wall of the duct.

13. The apparatus of claim 12 wherein the impeller of the air movement assembly is positioned adjacent to and is in fluid communication with the intake opening of the duct.

14. The apparatus of claim 12 wherein a motor access opening is formed in a second one of the side wall portions opposite of the intake opening in the one side wall portion.

15. A system comprising:

a storage bin having a peripheral wall defining a bin interior, a slot opening being formed in the peripheral wall, the peripheral wall having an outer surface which is substantially cylindrical about a vertical axis of the storage bin; and a bin ventilation apparatus for moving air into the bin interior of the storage bin, the bin ventilation apparatus comprising:

a duct defining a duct interior, the duct having an inboard end oriented toward the bin and an outboard end oriented away from the bin, the duct having an inboard opening at the inboard end, the duct having an outboard opening at the outboard end of the duct, the duct comprising a perimeter wall extending between the inboard end and the outboard end, the perimeter wall having an upper wall portion above the duct interior and a lower wall portion below the duct interior, the perimeter wall further having a pair of side wall portions on opposite sides of the duct interior and being united with the upper and lower wall portions, a cap assembly being positioned at the outboard end of the duct to close the outboard opening of the duct;

an air movement assembly mounted on the duct and being at least partially positioned in the duct interior between the inboard and outboard ends, the air movement assembly comprising a motor and an impeller rotatable by the motor to move air through the duct; and an interface flange forming an interface between the duct and the peripheral wall of the bin, the interface flange being located at the inboard end of the duct.

16. The system of claim 15 wherein the upper and lower wall portions of the perimeter wall converge toward the inboard end of the duct and diverge toward the outboard end of the duct.

17. The system of claim 16 wherein the opposite side wall portions of the perimeter wall converge toward the outboard end of the duct and diverge toward the inboard end of the duct.

18. The system of claim 17 wherein the upper and lower walls portions and the opposite side wall portions are substantially planar.

19. The system of claim 18 wherein the perimeter wall of the duct is formed between the inboard and outboard ends by a single piece of sheet material.

20. The system of claim 15 wherein the duct of the air movement assembly has a longitudinal axis extending between the inboard and outboard openings of the duct; and wherein the impeller has a rotation axis oriented substantially perpendicular to the longitudinal axis of the duct.

* * * * *